United States Patent [19]

Friberg et al.

[11] Patent Number: 4,756,101

[45] Date of Patent: Jul. 12, 1988

[54] SWING WHEEL SNOWTHROWER

[75] Inventors: Nathan J. Friberg; Steven J. Svoboda, both of Bloomington, Minn.

[73] Assignee: The Toro Company, Minneapolis, Minn.

[21] Appl. No.: 843,448

[22] Filed: Mar. 24, 1986

[51] Int. Cl.[4] ..... E01H 5/09

[52] U.S. Cl. ..... 37/244; 56/17.2

[58] Field of Search ..... 37/242–258, 37/260; 56/11.2, 11.8, 17.2; 172/114

[56] References Cited

U.S. PATENT DOCUMENTS

| | | | |
|---|---|---|---|
| 2,658,290 | 11/1953 | Pierce | 37/244 |
| 2,731,739 | 1/1956 | Miller . | |
| 2,863,162 | 12/1958 | Draughon | 37/243 |
| 3,115,714 | 12/1963 | Johann . | |
| 3,269,100 | 8/1966 | Smith | 56/17.2 |
| 3,468,041 | 9/1969 | Mattson et al. | 37/246 |
| 3,525,002 | 8/1970 | Mattson et al. . | |
| 3,836,430 | 5/1958 | Langenbacher | 37/243 |
| 4,104,812 | 8/1978 | Stribiak, Jr. . | |
| 4,186,967 | 2/1980 | Kuhmonen . | |
| 4,255,879 | 3/1981 | Greider . | |
| 4,514,917 | 5/1985 | Ogano et al. | 37/257 |
| 4,554,780 | 11/1985 | Umeno et al. | 56/17.2 |

FOREIGN PATENT DOCUMENTS

| | | | |
|---|---|---|---|
| 136142 | 3/1983 | Fed. Rep. of Germany . | |
| 157188 | 7/1978 | Netherlands | 56/17.2 |
| 1447501 | 8/1976 | United Kingdom | 56/17.2 |

*Primary Examiner*—E. H. Eickholt

*Attorney, Agent, or Firm*—James W. Miller

[57] ABSTRACT

An improved snowthrower (2) includes a housing (4) having a pair of traction wheels (20) carried thereon. Pivot arms (24) pivotably journal traction wheels (20) to the housing (4) for movement between a first position approximately beneath the center of gravity of the snowthrower to a rearward position. A control system (60) selectively swings the wheels between these two positions to obtain more downward force on the front of the snowthrower housing when hard packed or deep snow is encountered. The control system (60) includes a single control handle (62) for both manipulating the traction wheels (20) and for operating the transmission (46).

10 Claims, 3 Drawing Sheets

SWING WHEEL SNOWTHROWER

TECHNICAL FIELD

This invention concerns a snowthrower having a pair of traction wheels for self-propelling the snowthrower over the ground. More particularly, this invention relates to traction wheels that have multiple positions on the snowthrower housing for selectively changing the downward force seen at the front of the housing depending upon the snow conditions encountered.

BACKGROUND OF THE INVENTION

Powered snowthrowers of the walk behind type are well known. Such snowthrowers usually have a housing supported by wheels which carries a snowthrowing impeller or paddle at the front thereof for engaging and throwing snow. In addition, a handle assembly extends upwardly and to the rear from the housing so that the operator can hold the handle assembly and walk behind the snowthrower as it moves over the ground. In some cases, for example in a two stage snowthrower, the wheels which support the housing for movement over the ground can be selectively coupled to the power source to comprise traction or drive wheels. The wheels on a single stage snowthrower are not usually powered in this sense. Any self-propelling action usually comes from the engagement of the snowthrowing paddle with the ground.

Most two stage snowthrowers that utilize traction wheels also use a transmission for driving the traction wheels at different speeds and in different directions, i.e. either forward or reverse. In the two stage snowthrowers manufactured by The Toro Company, Minneapolis, Minn., the assignee of the present invention, two separate controls are provided to engage the traction wheels. The first control is a shift handle which the operator uses to select the forward speed and the direction of movement for the traction wheels. The second control is a deadman's handle which the operator must squeeze and keep closed to apply power to the traction wheels. In addition, in most snowthrowers of this type, the traction wheels are located approximately beneath the center of gravity or slightly behind the center of gravity of the snowthrower.

Two stage snowthrowers of the type described above are very effective in removing and throwing snow. However, the placement of the traction wheels in a fixed position approximately beneath the center of gravity of the snowthrower can, in certain limited circumstances, lead to some difficulties in using the snowthrower. This occurs primarily in wet, heavy or hard packed snow where the front of the snowthrower is attempting to push into the snow pack. In such conditions, the front of the snowthrower tends to climb up over the snow rather than bite into the snow. The operator then has to lift upwardly on the handle assembly and apply a fairly continuous upward pressure in many cases to keep the front of the snowthrower down. This can be tiring and difficult to do. Moreover, lifting upwardly takes weight off the wheels thereby losing traction. However, in most other snow conditions, i.e. smaller amounts of snow or loose packed snow, the traction wheel placement beneath the center of gravity is generally ideal. In other words, the traction wheels have enough tractive force to operate properly and bite into the snow, and also allow the snowthrower to be easily maneuvered in turning it from side to side.

Some prior art snowthrowers utilize a traction system which is different from that just described. Rather than use a pair of traction wheels, one on either side of the snowthrower, these models use instead elongated tracks with the tracks being supported on front and rear pulleys or sprockets. The front pulley for the sprocket is located generally beneath the center of gravity of the snowthrower, in a location similar to that of the conventional traction wheel, while the rear pulley is located considerably to the rear of the front pulley. The track is made of any suitably pliable material and may include ribs or cleats for engaging the snow in a manner similar to that of a snowmobile track. In addition, the rear pulley on which the track is supported can be vertically adjusted relative to the snowthrower housing to change the angle or inclination which the track makes with the snowthrower housing, and hence also with the ground.

SUMMARY OF THE INVENTION

One aspect of this invention is a snowthrower having a housing supported for movement over the ground by at least a pair of wheels rotatably carried thereon. A powered means is carried on the housing for throwing snow. The improvement of this invention comprises means for moving the wheels relative to the housing between fore and aft positions which are different distances from the center of gravity of the housing. This allows the distance between the center of gravity of the snowthrower and the point of contact of the wheels with the ground to be varied depending upon the snow conditions encountered.

BRIEF DESCRIPTION OF THE DRAWINGS

The present invention will be described in more detail hereafter in the Detailed Description, when taken in conjunction with the following drawings, in which like reference numerals refer to like elements throughout.

DETAILED DESCRIPTION

Figure 1:
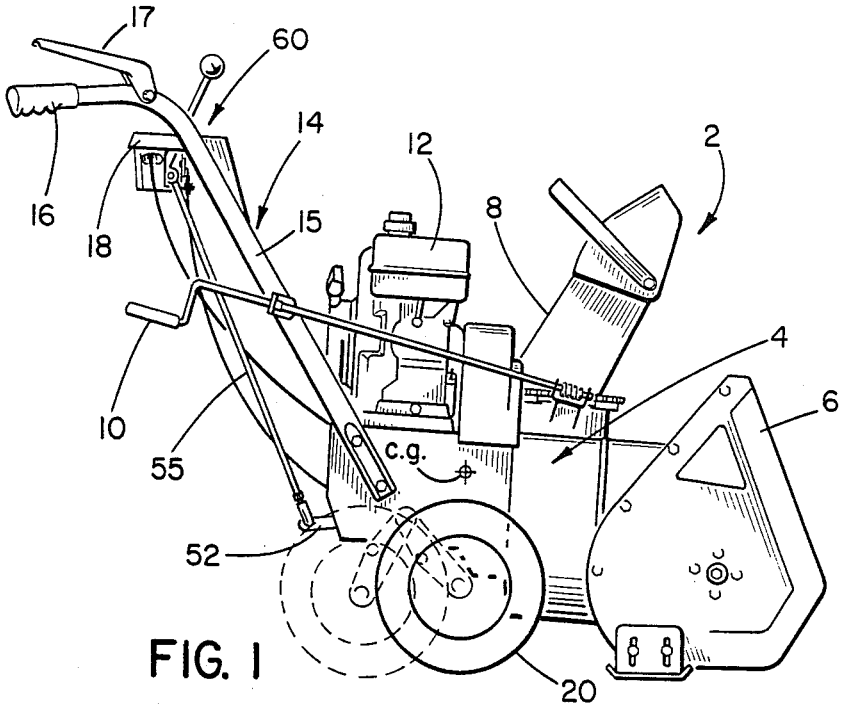
FIG. 1 is a side elevational view of an improved snowthrower according to the present invention, particularly illustrating the traction wheels in their fore and aft positions relative to the snowthrower housing.

An improved snowthrower according to the present invention is illustrated in FIG. 1 as 2. Snowthrower 2 as illustrated herein is a typical two stage snowthrower, such as the Model 524 manufactured by The Toro Company, Minneapolis, Minn. It includes a frame or housing 4 having a front snow contacting portion 6 in which a transverse auger is located. The auger bites into the snow and moves it through an opening in portion 6 back into contact with a high speed fan located rearwardly of the auger. This fan throws the snow upwardly through a vertically extending chute 8 which may be rotated by a crank mechanism 10 for varying the direction of the thrown snow stream.

The snowthrower includes a power source 12 of any suitable type, herein shown as an internal combustion engine, which may be selectively engaged with the auger and fan for powering the same. In addition, engine 12 also serves as the power source for supplying power to the traction wheels 20, in a manner to be described hereafter. Snowthrower 2 also includes a handle assembly 14 that extends upwardly and rearwardly from housing 4. This handle assembly includes two L-shaped handle tubes 15 attached to either side of housing 4 terminating in hand grips 16 which the operator holds while walking behind snowthrower 2. Deadman control handles 17 (only one of which is shown in FIG. 1) are located adjacent hand grips 16 for selectively engaging the auger and fan assembly as well as the traction wheels in any suitable manner as is well known in the art. A generally horizontal escutcheon plate 18 extends between and is secured to handle tubes 15 adjacent their upper ends to help join the handle tubes together.

Snowthrower 2 is supported for movement over the ground by a pair of traction or drive wheels 20, with one drive wheel 20 being located on each side of housing 4. An important feature of this invention is the ability of these drive wheels 20 to move, preferably as a pair, between one of two distinct positions relative to housing 4. The first position is located approximately underneath or slightly behind the center of gravity of the snowthrower, labeled c.g. in FIG. 1, the center of gravity being that point on the snowthrower frame which represents the center of the mass of all of the components of the snowthrower. This first or forward position is shown in solid lines in FIG. 1. The second or aft position of traction wheels 20 is shown in phantom in FIG. 1. In this latter position, wheels 20 have been moved to the rear of the center of gravity by a substantial distance. This pivoting motion of traction wheels 20, and the reasons therefor, will be discussed in more detail hereafter.

Figure 3:
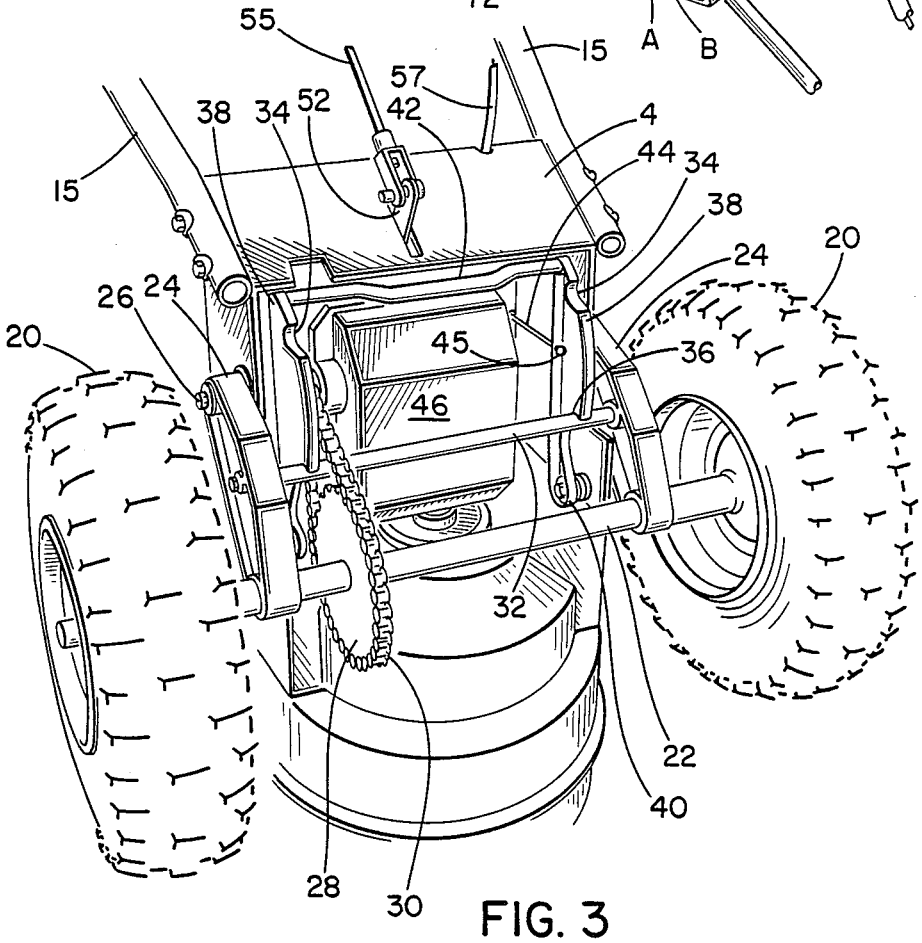
FIG. 3 is a partial perspective view of the snowthrower shown in FIG. 1 taken from the bottom, particularly illustrating the traction wheels and drive axle therefor along with the means for locking the traction wheels in either the fore or aft positions.

Referring to FIG. 3, traction wheels 20 are mounted on an axle shaft 22 that is pivotably carried on snowthrower housing 4 by substantially identical first and second support arms 24. Support arms 24 are pivoted at their upper ends by any suitable pivot pins 26 to the bottom of housing 4 and at their lower ends rotatably journal axle 22 using any suitable bushings or the like. A drive gear or sprocket 28 is fixed on axle shaft 22 and a chain 30 extends upwardly therefrom to an output drive sprocket 48 on transmission 46. In addition, a transverse locking rod 32 extends between and is joined to pivot arms 24 between the upper and lower ends thereof. Locking rod 32 cooperates with two opposed locking arms 38 to lock traction wheels 20 in either their fore or aft positions.

Locking arms 38 are pivotably attached by pivot pins 40 to the inside of the side plates of snowthrower housing 4. Locking arms 38 are united by a cross rod 42 to pivot together as a unit. Each arm 38 includes two spaced first and second notches 34 and 36 which engage with locking rod 32 and respectively define the first and second positions for traction wheels 20. An actuating cable 44 is connected in any suitable fashion to one of the locking arms 38, i.e. by having an enlarged head 45 on the cable abut against the bottom of a horizontal flange on the locking arm. An upward motion of cable 44 pivots the locking arms 38 upwardly together as a unit so that whatever set of notches 34 or 36 is engaging the locking rod 32 is disengaged therefrom. This pivoting motion is sufficient to overcome the force of a torsion spring or the like which normally forces the locking arms 38 downwardly into contact with the locking rod 32. After the locking arms 38 are disengaged from rod 32, traction wheels 20 may be moved between their respective positions. When cable 44 is then released, the torsion spring will cause the locking arms 38 to reengage with rod 32 with the other set of notches 34 or 36 then coming into engagement with the locking rod 32.

Figure 2:
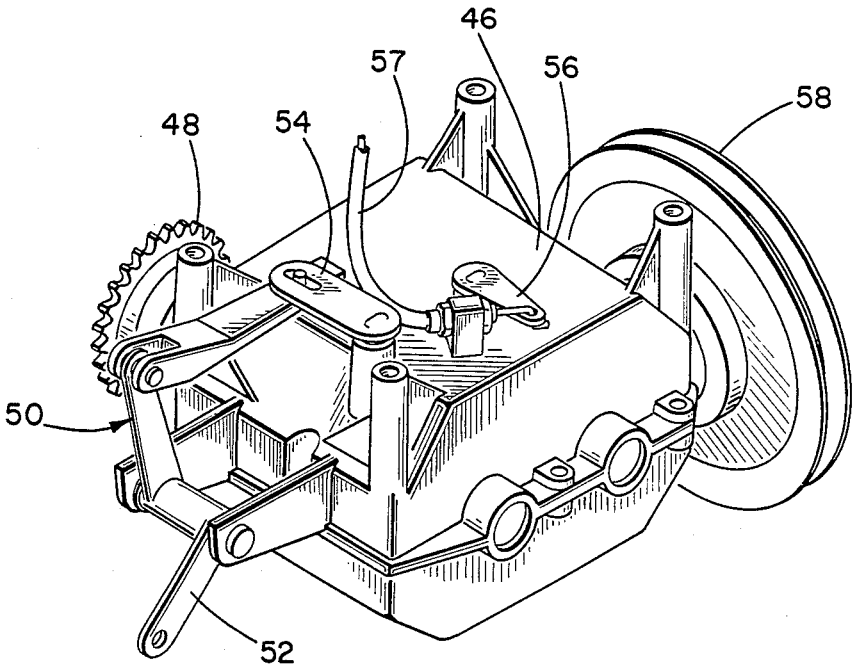
FIG. 2 is a perspective view of a transmission which may be selectively coupled with the traction wheels of the snowthrower.

Referring now to FIGS. 2 and 3, the transmission 46 for traction wheels 20 is located inside housing 4 adjacent the bottom thereof. Transmission 46 may have any suitable design for achieving a plurality of multiple speeds and also forward and reverse directions. Transmission 46 includes an output sprocket 48 and an input drive pulley 50 connected by a drive belt to the engine 12. This drive belt is tensioned by an idler pulley arrangement whenever the appropriate deadman control 17 is squeezed shut by the operator to selectively apply power to transmission 46 and hence to the drive wheels 20. Preferably, transmission 46 is of a draw key type in which a draw key slides in a groove in an output shaft and couples one of a plurality of speed change gears on the output shaft to the input shaft. The transmission may be switched from forward to reverse by changing the direction of rotation of the input shaft. One transmission of this general type is shown in U.S. Pat. No. 1,985,015 to Bush, which is hereby incorporated by reference .

In any event, as shown in FIG. 2, there are two separate actuating elements which operate the transmission. The first is a lever assembly 50, which includes a pivotal lever arm 52 connected through the other components of the linkage 50 to a first pivotal tab 54. Rotation of lever arm 52 will operate through the linkage 50 to rotate first tab 54. Tab 54 is suitably connected in any manner to the draw key inside transmission 46 to slide the draw key through the groove in the output shaft to select the different speeds. In addition, transmission 46 further includes a second pivotal tab 56 which is connected internally in the transmission to any suitable means for changing the direction of rotation of the output shaft to select either a forward or reverse direction. First pivotal tab 54 is connected to and is operated by an upwardly extending actuating rod 55 and second pivotal tab 56 is connected to and is operated by an upwardly extending actuating cable 57.

Figure 5:
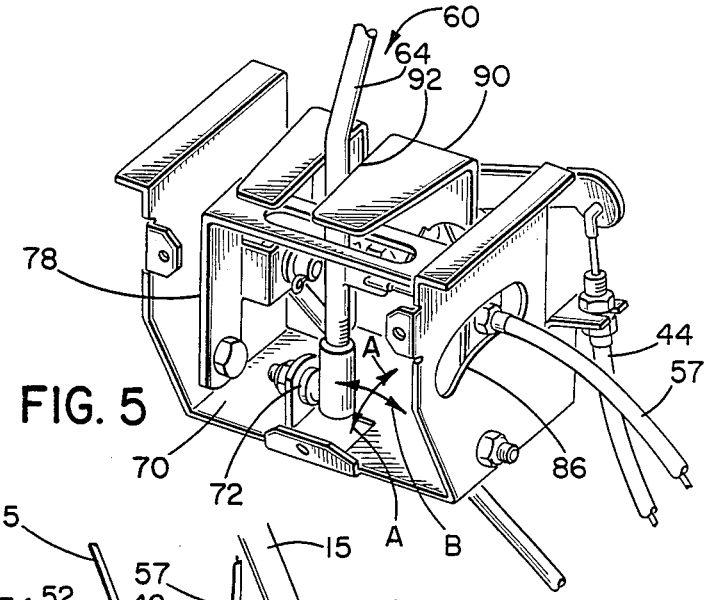
FIG. 5 is a perspective view of the control system shown in FIG. 4 illustrated in an assembled position.
Figure 4:
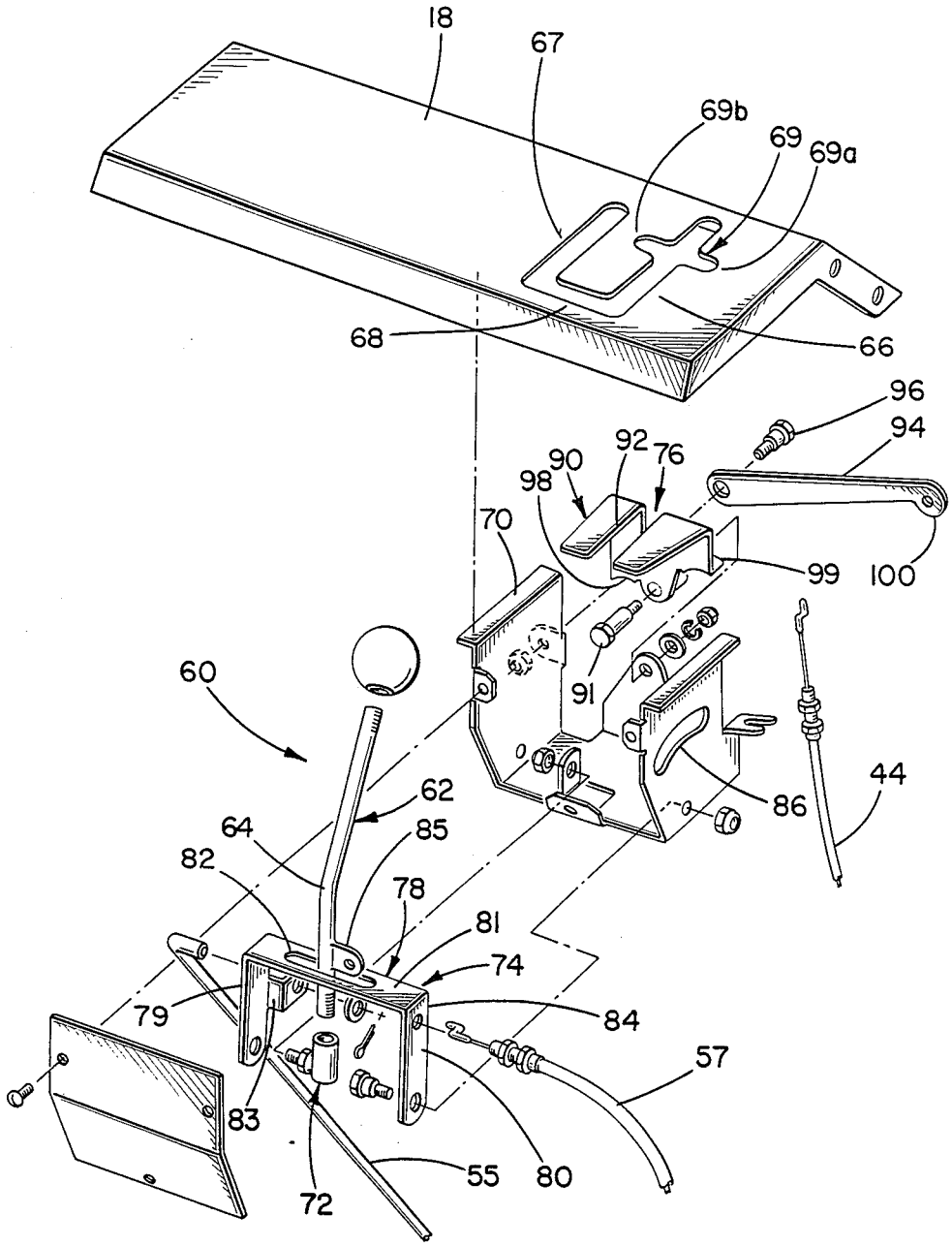
FIG. 4 is an exploded perspective view of the control system for operating the transmission and traction wheels of the snowthrower.

Referring now particularly to FIGS. 4 and 5, the control system for operating the traction wheels 20, i.e. for allowing them to move between their fore and aft positions, will be described and is generally illustrated as 60. For simplicity and ease of use, control system 60 has also been integrated into and made a part of the same control system which is used to operate transmission 46. While this is not strictly necessary to that aspect of the invention relating to the movable traction wheels 20, i.e. a separate control handle could be provided only for traction wheels 20, it is preferred to integrate the two.

Control system 60 includes a moveable control handle 62 which is located on handle assembly 14 at escutcheon plate 18 which the operator uses to manipulate the various controlled elements, namely traction wheels 20 and transmission 46. Control handle 62 includes an upwardly extending stem 64 that extends through a U-shaped shift pattern in escutcheon plate 18 having first and second longitudinal legs 66 and 67 and a short transverse connecting leg 68. One of the longitudinal legs 66 in the shift pattern also includes a short transverse slot 69 midway up its length having right and left halves 69*a* and 69*b*.

Mounted beneath escutcheon plate 18 is a suitable structure for allowing control handle 62 to traverse the entire shift pattern. This includes an upwardly extending U-shaped cradle 70 which is fixedly attached in any suitable manner to the underside of escutcheon plate 18. The lower end of control handle 62 is pivotably mounted to the bottom wall of cradle 70 for movement in two degrees of freedom by a ball and socket joint 72. In other words, control handle 62 can move longitudinally relative to cradle 70 as shown by the arrows A and also transversely in a side-to-side direction as shown by arrows B.

Mounted within cradle 70 are first and second means, identified generally as 74 and 76, for coupling various motions of control handle 62 to the various actuating cables and rods. The first coupling means 74 comprises a U-shaped saddle 78 having left and right side walls 79 and 80 and an upper horizontal wall 81 containing a transverse slot 82. Saddle 78 is itself pivotally secured to the inside of cradle 70 as shown in FIG. 5. Saddle 78 includes a longitudinally extending flange 83 to which the upper of the actuating rod 55 is connected, the rod 55 extending up through one of the open ends of cradle 70 to its point of attachment to flange 83. In addition, saddle 78 also includes a hole 84 in one of the vertical side walls 80 thereof for allowing the movable inner portion of the actuating cable 57 to extend therethrough and be connected directly to the stem 64 of handle 62 by a flange 85. The outer part of cable 57 is fixed by jam nuts to the vertical side wall 80 of saddle 78 and passes outwardly through a curved slot 86 in the side of cradle 70 as it extends down to the transmission. Accordingly, saddle 78 has means for connecting two of the three actuating elements, namely cable 57 which is directly connected to control handle 62 and also the actuating rod 55 which is directly coupled to saddle 78.

The second coupling means 76 includes an L-shaped linkage member 90 which is secured by a pivot pin 91 inside U-shaped cradle 70 so as to be pivotal in a transverse side-to-side direction. L-shaped member 90 again includes a slot 92, this time longitudinally extending, in which the stem of handle 62 is received. Slot 92 normally underlies the longitudinal leg 66 of the shift pattern and the escutcheon plate 18, but does not extend as far as the transverse leg 68. Thus, movement of control stem 64 along longitudinal leg 66 will cause the control stem to move inside slot 92, but the stem can be moved outside slot 92 by first entering transverse leg 68. In addition, the second coupling means 76 further includes an outwardly extending lever arm 94 pivotally secured to one side of cradle 70 by a pivot pin 96 for motion in an up and down vertical direction. The L-shaped linkage member 90 has first and second rearwardly extending tabs 98 and 99 on either side of the pivot pin for member 90. Tabs 98 and 99 abut against the underside of lever arm 94 so that rotation of linkage member 90 in either transverse direction will be converted solely to an upward vertical motion of lever arm 94. The outside of lever arm 94 has a connecting point or flange 100 to which is secured the slidable actuating portion of the cable 44.

Referring now to the operation of the control system 60 and snowthrower 2, movement of control handle 62 and the first coupling means 74 selects different speeds and directions for transmission 46 and unlocks the traction wheels 20 as well. The shift pattern shown on escutcheon plate 18 includes the two forwardly extending longitudinal legs or slots 66 and 67 which respectively allow movement of control handle 62 in the longitudinal direction needed to actuate the transmission shift key. In other words, when control handle 62 is positioned with the stem 64 received in either of the two longitudinal slots 66 or 67, movement of the control handle along the length of the slots causes saddle 78 to pivot in a longitudinal direction inside cradle 70 as shown by the arrows A. The actuating rod 55, which in turn is connected to the first pivotal tab 54 on the transmission 46, draws the shift key through the slot in the output shaft to couple up the different change speed gears and thereby change the speed of the transmission. In addition, movement of the control handle 62 in the short transverse connecting leg 68 is what is effective to cause the selection of forward or reverse in the transmission. This is done since the movement of control handle 62 in the transverse leg 68, which is allowed by virtue of the elongated slot 82 in saddle 78 and by the ball and socket mounting of control handle 62, pulls on the slidable portion of cable 57. This in turn pivots the second tab 56 on the transmission to cause the transmission to shift from forward to reverse.

The transverse slot 69 midway up the first longitudinal leg or slot 66 in the shift pattern, along with the second coupling means 76, is what allows the traction wheels 20 to be shifted between their fore and aft positions. Assuming for the moment that the control handle 62 is positioned midway up slot 66 so as to be aligned with the transverse slot 69, it should be apparent that a pivoting movement of control handle 62 into either half 69*a* or 69*b* of slot 69 will unlock locking arms 38 from locking rod 32. This occurs because this pivoting movement is converted through the second coupling means 76, including L-shaped linkage member 90 and outwardly extending lever arm 94, into an upward pull on the slidable portion of actuating cable 44. This movement pulls upwardly on locking arms 38 to disengage them from locking rod 32. Thus, movement either to the left or right into the two halves 69*a* or 69*b* of the transverse slot 69 unlocks traction wheels 20 allowing them to be moved between their respective fore and aft positions.

The purpose of having two opposed halves 69*a* and 69*b* for transverse slot 69 and in having slot 69 be positioned midway up longitudinal leg 66, i.e. in the second forward gear, is to allow transmission 46 to be operated to help positively drive the wheels between their fore and aft positions. For example, considering the situation where the traction wheels are located in their forward solid line positions in FIG. 1, if the operator wishes to move wheels 20 to their rearward position, he simply moves control handle 62 to the location of the transverse slot 69 in the first leg 66. Then, with the engine operating, he shifts the control handle in the left direction to cause the control handle 62 to move into the left hand half 69*b* of the transverse slot 69. This motion unlocks the traction wheels and also causes the transmission to shift from a forward to a reverse orientation at a position where the second speed of the transmission has already been selected. If the operator also then grabs the deadman handle 17 to apply power to the transmission from the engine, the traction wheels 20 will be tractively driven in a reverse direction actually physically driving the traction wheels 20 relative to housing 4 from their forward to their aft position. If the wheels had originally been in their aft positions and the operator had wanted to go forward, he would have simply moved control handle 62 into the right hand half 69*a* of the transverse slot 69. In this position, when the deadman handle 17 was energized, the wheels 20 would have again been positively driven, but this time in a forward direction to help drive them from their aft to their forward position.

Accordingly, snowthrower 2 according to the present invention has some definite advantages over prior art snowthrowers. For one thing, it retains the advantages of a snowthrower having driven traction wheels, rather than a track, in terms of ease of manipulation, especially in a free wheeling condition when no power is being applied to the wheels. In their normal or forward position, the wheels are approximately beneath and slightly behind the center of gravity allowing maximum ease in turning the unit from side to side. However, whenever deep or hard packed snow is encountered the operator by suitable manipulation of control handle 62 can shift the wheels 20 from their forward to their aft position, thereby increasing the distance which exists between the center of gravity of the machine and the point of contact of the wheels to put substantially more downward force on the front of the snowthrower. In addition, the operator can now apply considerably more downward force on the handle assembly without tipping the front of the snowthrower up. This enables the snowthrower to more effectively bite into the snow and remove it with less effort required by the operator. However, the traction wheels 20 can be easily put back into their forward position when required by different snow conditions.

Another advantageous feature of this invention is the ability to drive the traction wheels 20 during the shifting operation so as to assist their movement between their fore and aft positions. This is also desirably done by integrating into the control handle 62 which operates the transmission the means needed for unlocking the traction wheels 20 to move them between their fore and aft positions. While this integration is desirable, totally separate control systems could be used. Moreover, it is not strictly necessary for the present invention that the traction wheels be positively driven during their shifting movement. It would be possible to move the wheels between their fore and aft positions merely by having the wheels spring loaded to one of the two positions and by being able to unlock the wheels. Then, the operator could manually move the axle with his foot or the like between the positions, or by virtue of manipulating the handle assembly on the snowthrower could cause the weight of the snowthrower to act on the wheels to force movement of the wheels between the two positions.

In using control handle 62 according to this invention, it is necessary for the operator when attempting to drive the traction wheels during their shifting motion to move the control handle 62 into the appropriate half 69*a* or 69*b* of the transverse slot 69. This may be confusing to some operators who, if they move the control handle into the wrong slot, will not have the wheels rotating in the appropriate direction to drive the wheels from one position to the other. For example, movement of the control handle into the right hand slot 69*a* while the wheels are in their forward position would not be effective to drive them to their rearward position since forward direction of wheel rotation would have been obtained. Thus, it might be desirable in some instances to have only one half of the slot 69, namely the forward extending half 69*a*, which would allow only one choice to be made by the operator in attempting to move the traction wheels. Then, some additional means of any suitable structure would be incorporated to cause the transmission to be automatically manipulated to engage the traction wheels in the appropriate driving direction. This could be done by some mechanism which would alternately be engaged for to cause the control wheels to be driven in alternate directions each time the control handle is moved in slot half 69*a*. For example, assuming the wheels were in their forward position, movement of the control handle into the transverse slot half 69*a* the first time would automatically put the transmission into reverse causing the wheels to be driven in their rearward direction. This is the proper direction needed for moving the wheels from their forward to their rearward position. The next time the control handle is moved into the slot 69*a*, the transmission would automatically be placed into a forward condition for driving the wheels back to their forward position. Then, the third time the wheels 20 would be driven in the reverse direction, and so on.

Various modifications of this invention will be apparent to those skilled in the art. Thus, the scope of the invention is to be limited only by the appended claims.

We claim:

1. An improved snowthrower of the type having a frame movably supported by a pair of rotatable wheels; an engine carried on the frame for providing power; impeller means driven by the engine and carried on the front of the frame for contacting and throwing snow; means for propelling the frame relative to the ground; and a handle assembly extending rearwardly relative to the frame which an operator can hold to guide the frame, wherein the improvement comprises:

means for movably mounting the wheels to the frame for selective movement between a first position and a second position located to the rear of the first position, wherein the wheels are in engagement with the ground in both the first and second positions thereof, and wherein the first position of the wheels is located on the frame approximately beneath or slightly behind the center of gravity of the frame, and the second position of the wheels is located to the rear of the center of gravity of the frame, whereby the wheels may have their position changed depending on the snow conditions encountered.

2. An improved snowthrower as recited in claim 1, wherein the wheels are carried on a common axle.

3. An improved snowthrower as recited in claim 2, wherein the wheel moving means comprises means for pivotably supporting the axle on he housin for a swinging motion between the first and second positions of the wheels.

4. An improved snowthrower as recited in claim 3, wherein the housing has left and right sides, and wherein the wheels consist of a single pair of wheels with each wheel in the pair being adjacent one side of the housing.

5. An improved snowthrower as recited in claim 3, wherein the pivotal support means comprises first and second support arms having upper and lower ends, wherein the support arms are pivotably secured at their upper ends to the housing, and wherein the axle is rotatably journalled at the lower ends of the support arms.

6. An improved snowthrower as recited in claim 5, further including means for locking the wheels in either the first and second positions.

7. An improved snowthrower as recited in claim 6, wherein the locking means comprises:.

(a) a locking rod extending between and connecting the support arms;

(b) at least one locking arm pivotally carried on the housing and having a pair of locking notches for engaging the locking rod to secure the support arms in either the first and second positions of the wheels; and (c) means for biasing the locking arm into engagement with the locking rod.

8. An improved snowthrower as recited in claim 7, further including selectively operable control means for pivoting the locking arm away from the locking rod against the biasing thereon to release the support arms and thereby allow the support arms to be pivoted between their first and second positions.

9. An improved snowthrower as recited in claim 1, wherein the frame propelling means comprises transmission means for selectively driving the wheels from the engine.

10. An improved snowthrower as recited in claim 9 further including control means for engaging the transmission means during movement of the wheels between their first and second positions to allow the wheels to be positively driven between their first and second positions.

* * * * *

US004756101B1

REEXAMINATION CERTIFICATE (2183rd)

United States Patent [19]

Friberg et al.

[11] B1 4,756,101

[45] Certificate Issued Jan. 11, 1994

[54] SWING WHEEL SNOWTHROWER

[75] Inventors: Nathan J. Friberg; Steven J. Svoboda, both of Bloomington, Minn.

[73] Assignee: The Toro Company, Minneapolis, Minn.

Reexamination Request:
No. 90/002,326, Apr. 22, 1991

Reexamination Certificate for:

| | |
|---|---|
| Patent No.: | 4,756,101 |
| Issued: | Jul. 12, 1988 |
| Appl. No.: | 843,448 |
| Filed: | Mar. 24, 1986 |

[51] Int. Cl.[5] ..... E01H 5/09
[52] U.S. Cl. ..... 37/244; 56/17.2
[58] Field of Search ..... 37/244, 245, 246, 247, 37/DIG. 1, DIG. 17

[56] References Cited

U.S. PATENT DOCUMENTS

| | | |
|---|---|---|
| 1,334,923 | 3/1920 | Reynolds . |
| 1,603,978 | 10/1926 | Parkhurst . |
| 1,889,241 | 11/1932 | Gibson et al. . |
| 1,985,015 | 12/1934 | Bush . |
| 2,544,774 | 3/1951 | Bredl et al. . |
| 2,658,920 | 11/1953 | Pierce . |
| 2,692,445 | 10/1954 | Darnell . |
| 2,714,933 | 8/1955 | Harris . |
| 2,731,739 | 1/1956 | Miller . |
| 2,836,430 | 5/1958 | Langenbacher . |
| 2,863,162 | 12/1958 | Draughon . |
| 2,967,388 | 1/1961 | Watkins . |
| 3,043,028 | 7/1962 | Merry et al. . |
| 3,115,714 | 12/1963 | Johann . |
| 3,239,954 | 3/1966 | Brier . |
| 3,269,100 | 8/1966 | Smith . |
| 3,272,030 | 9/1966 | Blozis . |
| 3,363,345 | 1/1968 | Ober . |
| 3,423,856 | 1/1969 | Fiske . |
| 3,468,041 | 9/1969 | Mattson et al. . |
| 3,525,002 | 8/1970 | Mattson et al. . |
| 4,104,812 | 8/1978 | Stribiak, Jr. . |
| 4,164,983 | 8/1979 | Hoch . |
| 4,186,967 | 2/1980 | Kuhmonen . |
| 4,255,879 | 3/1981 | Greider . |
| 4,514,917 | 5/1986 | Ogano et al. . |
| 4,554,780 | 11/1985 | Umeno et al. . |
| 4,699,219 | 4/1984 | Durrant et al. . |

FOREIGN PATENT DOCUMENTS

| | | |
|---|---|---|
| 3136142 | 3/1983 | Fed. Rep. of Germany . |
| 157188 | 1/1978 | Netherlands . |
| 1447501 | 8/1976 | United Kingdom . |

OTHER PUBLICATIONS

Barnacle Parp's Guide to Garden & Yard Power Tools, pp. 123–130, 1983.
Page from Gilson Tiller catalog, 1980, illustrating "Proper depth stick use . . . ".
Pp. 24 and 25 from Simplicity Catalog, mid-1970's.
Simplicity brochure entitled "Winter, after Winter, after Winter . . . ", 1984.
Sunbeam brochure entitled "Gas and Electric Snow Champ Power", 1978.
1963 MTD brochure relating to T200 and T300 Rotary Tillers.
Owner's Manual for Toro 3, 4 and 5 HP Tillers, 1971.
Owner's Manual for Toro 2 and 4 hp Tiller, Form 3310–898, 1977.
Parts Catalog for Toro 2 & 4 hp Tiller, Form 3310–979, 1977.
Yamaha YS-524T Owner's Manual, 75V-28199-30, date unknown.
Honda HS50 Owner's Manual, date unknown.
Honda HS55/HS70 Owner's Manual, Jul. 1984.

*Primary Examiner*—Randolph A. Reese

[57] ABSTRACT

An improved snowthrower (2) includes a housing (4) having a pair of traction wheels (20) carried thereon. Pivot arms (24) pivotably journal traction wheels (20) to the housing (4) for movement between a first position approximately beneath the center of gravity of the snowthrower to a rearward position. A control system (60) selectively swings the wheels between these two positions to obtain more downward force on the front of the snowthrower housing when hard packed or deep snow is encountered. The control system (60) includes a single control handle (62) for both manipulating the traction wheels (20) and for operating the transmission (46).

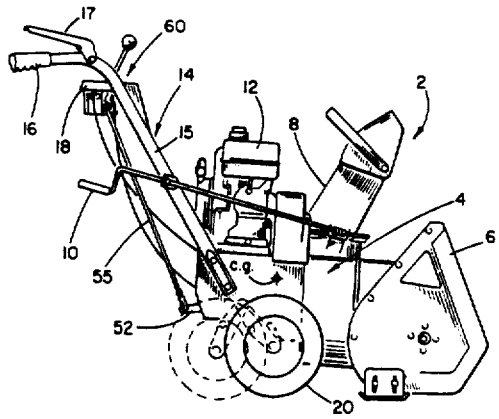

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3, 6, 7, and 10 are determined to be patentable as amended.

Claims 2, 4, 5, 8, and 9, dependent on an amended claim, are determined to be patentable.

New claims 11, 12, 13, and 14 are added and determined to be patentable.

1. An improved snowthrower of the type having a frame movably supported by a pair of rotatable wheels; an engine carried on the frame for providing power; impeller means driven by the engine and carried on the front of the frame for contacting and throwing snow; means for propelling the frame relative to the ground; and a handle assembly extending rearwardly relative to the frame which an operator can hold to guide the frame, wherein the improvement comprises:

means for movably mounting the wheels to the frame for selective movement between a first position and a second position located to the rear of the first position, wherein the wheels are in engagement with the ground in both the first and second positions thereof, and wherein the first position of the wheels is located on the frame approximately beneath [or] *to* slightly behind the center of gravity of the frame, and the second position of the wheels is located to the rear of the center of gravity of the frame, whereby the wheels may have their position changed depending on the snow conditions encountered.

3. An improved snowthrower as recited in claim 2, wherein the [wheel moving means] *the means for movably mounting the wheels* comprises means for pivotably supporting the axle on [he housin] *the housing* for a swinging motion between the first and second positions of the wheels.

6. An improved snowthrower as recited in claim 5, further including means for locking the wheels in either the first [and] *or* second positions.

7. An improved snowthrower as recited in claim 6, wherein the locking means comprises:

(a) a locking rod extending between and connecting the support arms;

(b) at least one locking arm pivotally carried on the housing and having a pair of locking notches for engaging the locking rod to secure the support arms in either the first [and] *or* second positions of the wheels; and (c) means for biasing the locking arm into engagement with the locking rod.

10. An improved snowthrower as recited in claim 9, further including control means for engaging the transmission means during movement of the wheels between their first and second positions to allow the wheels to be positively driven between their first and second positions, *wherein the control means includes:*

*(a) a first movable control handle which may be selectively manipulated by the operator;*

*(b) first coupling means for coupling a first motion of the first control handle to the transmission means;*

*(c) second coupling means for coupling a second motion of the first control handle to a wheel unlocking means to unlock the wheels to allow them to be moved between their first and second positions and vise versa; and*

*(d) wherein the first and second coupling means are configured relative to one another to allow the first coupling means to be moved by the first motion of the first control handle without effecting movement of the second coupling means such that the transmission means can be operated to drive the snowthrower without unlocking the wheels, but the second coupling means cannot be operated to unlock the wheels without the first coupling means being moved to a position in which the first coupling means engages the transmission means to thereby automatically place the snowthrower wheels into condition to be driven whenever they are unlocked by the second motion of the first control handle.*

*11. An improved snowthrower as recited in claim 10, wherein the first and second motions of the first control handle needed to operate the first and second coupling means are in different directions relative to one another.*

*12. An improved snowthrower as recited in claim 11, wherein the first and second motions of the first control handle are in directions which are perpendicular to one another.*

*13. An improved snowthrower as recited in claim 12, wherein the transmission means comprises a multi-speed transmission having speed selecting means for choosing one of a number of different speeds such that the transmission means is capable of driving the wheels at different speeds as determined by the position of the speed selecting means, and wherein the first coupling means is connected to the speed selecting means of the transmission to vary the position of the speed selecting means, and wherein the control means further includes a separate second control handle for applying power to the transmission from the engine to cause the transmission and the wheels to be driven at whatever speed has been selected by the first control handle.*

*14. An improved snowthrower as recited in claim 10, wherein the transmission means comprises a multi-speed transmission having speed selecting means for choosing one of a number of different speeds such that the transmission means is capable of driving the wheels at different speeds as determined by the position of the speed selecting means, and wherein the first coupling means is connected to the speed selecting means of the transmission to vary the position of the speed selecting means, and wherein the control means further includes a separate second control handle for applying power to the transmission from the engine to cause the transmission and the wheels to be driven at whatever speed has been selected by the first control handle.*

* * * * *